United States Patent [19]

Zak

[11] Patent Number: 4,539,002

[45] Date of Patent: Sep. 3, 1985

[54] CONTROL APPARATUS FOR TRAILING EDGE FOLDER IN CARTON FOLDING MACHINE

[75] Inventor: Chet Zak, Newbury, Mass.

[73] Assignee: Post Machinery Company, Inc., Portsmouth, N.H.

[21] Appl. No.: 401,098

[22] Filed: Jul. 23, 1982

[51] Int. Cl.[3] ..... B31B 1/54

[52] U.S. Cl. ..... 493/23; 493/21; 493/35; 493/177; 493/183

[58] Field of Search ..... 493/23, 21, 25, 35, 493/36, 177, 183, 182, 180, 32, 33, 31

[56] References Cited

U.S. PATENT DOCUMENTS

| | | | |
|---|---|---|---|
| 2,774,592 | 12/1956 | Kagan | 493/23 |
| 2,993,693 | 7/1961 | Buss et al. | 493/23 X |
| 3,110,232 | 11/1963 | Frei | 493/23 X |
| 3,449,592 | 6/1969 | Sjostrom | 493/23 X |
| 3,901,134 | 8/1975 | Reizenstein et al. | 493/32 X |
| 4,432,745 | 2/1984 | Eldridge | 493/177 X |

*Primary Examiner*—James F. Coan

*Attorney, Agent, or Firm*—Fitch, Even, Tabin & Flannery

[57] ABSTRACT

Control apparatus controls the operation of a trailing edge folder in a carton blank folding machine. The folding machine has conveyor means for continuously advancing blanks in a predetermined direction in untimed relationship to one another along a generally horizontal path. The trailing edge folder has a rotatable shaft mounted below and transverse to the path. The shaft has mounted thereon for rotation therewith one or more arms which extend outwardly from the axis of the shaft. Folding heads extend from the distal ends of the arms. The control apparatus has a sensor which produces a trailing edge signal indicating the departure of the trailing edge of a blank from a first location along the path upstream of the folder. At the end of a determined interval after the trailing edge signal the shaft is rotated in the direction in which the carton is travelling so that a head on the shaft comes into contact with the trailing panel of the blank, and folds it over about 180°. The shaft is stopped there until the carton panel slides out from under and out of the path of travel of the head. The shaft is then rotated further to a dwell position beneath the path and stopped at that point until the next blank is sensed. The control apparatus may be adjusted for different machine speeds, and differently sized cartons. Circuitry for monitoring operation, for making adjustments, and for detecting and diagnosing malfunctions is also provided.

17 Claims, 11 Drawing Figures

U7 (3)
U23 (1)
10K
VDD
U18-4
U18-3
U8 (1)
C1
100pf
R1
10K
VDD
U6 HUND
U5 TEN
U4 UNIT
U12
114
112
U17 13
U18 1,2
178
RESET
U7 2

110a
168
166
170
198
510
332 STOP
330 START
199
VDD
20K
U41
U29 (1)
U29 (2)
U29 (3)
150
148
158
STOP DETECTOR
72a
CARTON DETECTOR
36
STOP DETECTOR
72b 127
154
152
D44(A)
D44(B)
CLUTCH DRIVE
BRAKE DRIVE
333
335
1μf
LM 350
IN
OUT
100
R6
20K
R5
10K
R7
D44 (C)
10K
CR2
10K
1N914
CR1
U39
129
160
V+
10K
333
335
10K
V+

CONTROL APPARATUS FOR TRAILING EDGE FOLDER IN CARTON FOLDING MACHINE

This invention relates to control apparatus for manufacturing cardboard cartons and the like, and more particularly to control apparatus for machinery for folding the trailing panels of carton blanks conveyed along a straight line path.

BACKGROUND OF THE INVENTION

In processing lines where carton blanks are conveyed along a straight line path for folding and gluing, it is relatively straightforward to engage the leading and lateral edge panels or flaps with plows or shoes or the like and fold them into position for gluing. The trailing panels or flaps of carton blanks are more difficult to engage and fold because the blanks are moving in the direction of the fold and hence away from any folding mechanism.

A trailing edge folder for use in combination with a blank folding machine has recently been developed which overcomes this difficulty. The trailing edge folding mechanism includes an intermittently rotatable shaft mounted below and transverse to the horizontal path of the carton blanks. The shaft includes an arm or arms that extend generally radially from the shaft. The arms have folding heads at their distal ends for contacting and folding the trailing panels of successive blanks along fold lines parallel to the respective trailing edges. The shaft stops and pauses when a respective trailing edge is folded about 180° on the fold line. After the panel is pulled from under a head and the blank is out of the path of the head, the shaft rotates further to a dwell position until the next blank appears along the path.

The machine just described is designed to operate automatically at a high rate, and may fold the trailing panels of more than ten cartons per second. The folding machine conveyor may travel at up to about 600 feet per minute. Proper operation of the machinery requires sophisticated apparatus for accurately and reliably controlling the operation of the trailing edge folder. The control apparatus should be adjustable for use at different operating speeds, and with differently sized carton blanks. It should also detect malfunctions, and provide diagnostic aids for maintenance.

Accordingly, an aspect of this invention is to provide new and improved control apparatus for a trailing edge folder in carton manfacturing machinery.

Another aspect is to provide new and improved control apparatus for a trailing edge folder which incorporates the features just described.

SUMMARY OF THE INVENTION

Control apparatus controls the operation of a trailing edge folder in a carton blank folding machine. The folding machine has conveyor means for continuously advancing blanks in a predetermined direction in untimed relationship to one another along a generally straight horizontal path. The trailing edge folder has a rotatable shaft mounted below and transverse to the path. The shaft may be rotated intermittently by drive means and a clutch/brake mechanism. One or more arms extend generally radially from the shaft, and folding heads extend at generally right angles from the distal ends of the respective arms. The control apparatus has a blank sensor which produces a trailing edge signal indicating the passing of the trailing edge of a blank at a first location along the path upstream of the folder. Panel length advance means responsive to an input signal produces a panel length output signal after an interval which is related to the length of the trailing panel of the carton, and response time advance means responsive to an input signal produces a response time output signal after an interval which is related to a respective response time delay of the shaft clutch/brake mechanism. The trailing edge signal is applied as an input signal to either the panel length advance means or the response time advance means, and the output of that means is applied as an input to the other means to develop a first advance control signal at the end of an interval following the trailing edge signal which interval is substantially the sum of the interval related to the length of the trailing panel and the interval related to the response time delay. First advance control means responsive to the first advance control signal cause the shaft to rotate after the response time delay in the direction in which the carton is travelling. The shaft drive means rotate the shaft so that the heads on the shaft travel faster than the blanks and catch up to and come into contact with particular places on the respective trailing panels upstream of respective fold lines parallel to the trailing edges to fold the trailing panels along the fold lines. First position sensing means responsive to the rotation of the shaft to a first predetermined position produce a first position signal which is applied to the response time advance means to develop a first stop control signal. First stop actuating means responsive to the first stop control signal cause the shaft operating means to stop the shaft after the respective response time delay, and pause means responsive to the first stop control signal and operation of the conveyor means produce a second advance control signal after a predetermined period of travel to permit the trailing panel to slide out from under and out of the path of travel of the head. Second advance control means responsive to the second advance control signal cause the shaft operating means to further rotate the shaft. Second position sensing means responsive to the further rotation of the shaft to a second predetermined position produce a second position signal which is applied to the response time advance means to develop a second stop control signal. Second stop actuating means responsive to the second stop control signal cause the shaft operating means to stop the shaft after the respective response time delay in a dwell position where the folding heads are clear of the path. The control apparatus may be adjusted for different machine speeds by adjusting the intervals of the response time advance means, and for different sized trailing panels by adjusting the interval of the trailing panel advance means. Circuitry for monitoring operation, for making adjustments, and for detecting and diagnosing malfunctions is also provided.

BRIEF DESCRIPTION OF THE DRAWINGS

The above-mentioned and other features of this invention and their manner of operation will become more apparent, and the invention itself will be best understood by reference to the following detailed description of a preferred embodiment of the invention, particularly when taken in conjunction with the accompanying drawings, in which.

DESCRIPTION OF THE PREFERRED EMBODIMENTS

Figure 1:
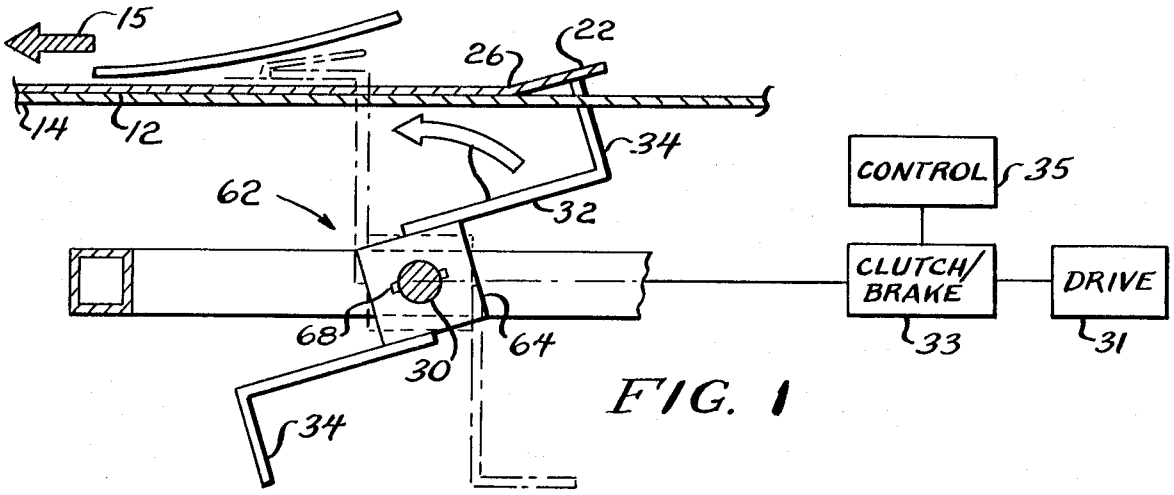
FIG. 1 is a partially cutaway side view of a portion of the trailing edge folder which the apparatus of the present invention controls, with certain parts shown diagrammatically.

The control apparatus of the present invention is particularly adaptable for use with the trailing edge folder shown in FIG. 1, as described more fully in U.S. Pat. No. 4,432,745, issued Feb. 21, 1984. by Charles W. Eldridge for Trailing Edge Folder. The trailing edge folder may be part of a carton blank folding machine having a generally horizontal conveyor 14 which continuously advances carton blanks 12 in the direction 15. The carton blanks 12 travel in generally untimed relationship to one another along the conveyor 14 in the folding machine.

Figure 2:
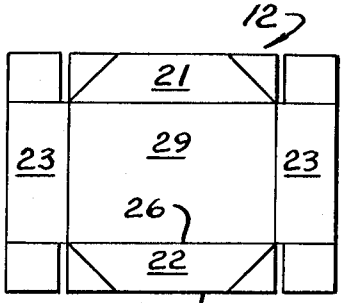
FIG. 2 is a plan view of a typical carton blank for use with the trailing edge folder of FIG. 1.

A typical carton blank 12 is shown in FIG. 2. The carton blank 12 includes a body or central panel 29, side panels 23, a front panel 21 and a trailing panel 22 having a transverse fold line 26 and trailing edge 28.

Figure 3:
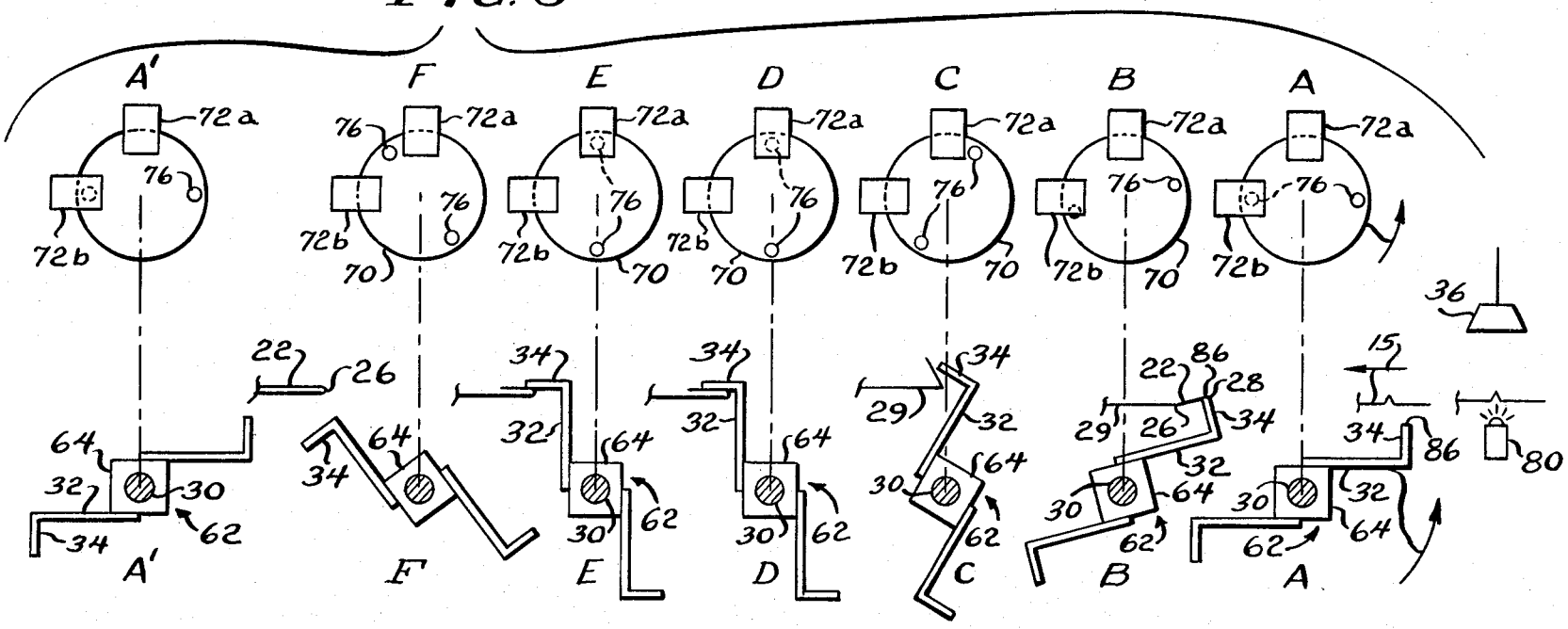
FIG. 3 comprises a series of time-lapse views showing several orientations of the rotating shaft of the trailing edge folder shown in FIG. 1, with attached arm means for folding the trailing panel, and corresponding orientations of an optically sensed encoder wheel carried by the shaft.

The trailing edge folder shown in FIG. 1 includes a rotatable shaft 30 mounted below and transverse to the conveyor 14. The shaft 30 may be rotated on an intermittent basis by a drive means 31 through a clutch/-brake mechanism 33 controlled by a control apparatus 35 of the present invention. The shaft 30 carries at least one assembly 62 mounted thereon for rotation therewith and having oppositely extending arms 32 extending generally radially from the shaft 30 which maintain the rotational balance of the shaft 30. The assembly 62 completes a folding cycle between one dwell position (FIG. 3A) and the next dwell position (FIG. 3A') during 180° rotation of the shaft.

Each arm 32 is offset from the rotational axis of the shaft 30 and carries a folding head portion 34 at its distal end. The heads 34 are generally perpendicular to the respective arms 32 and extend generally in the direction of rotation of the shaft 30. Rotation of the shaft 30 moves a respective head 34 from a generally vertical disposition in the first dwell position (FIG. 3A), completely removed from the path of blank travel on the conveyor 14, to a substantially horizontal disposition in a stop and pause position (FIG. 3D), holding the panel 22 against the body 29 of the blank 12. The arms 32 are mounted on a block 64 keyed to the shaft 30 for rotation therewith by a mating key and keyway arrangement 68. The block 64 spaces the arms 32 from the shaft axis a predetermined distance in the direction of conveyor travel in the pause position (FIG. 3D).

An encoding wheel 70 (FIG. 3) is also mounted on the shaft 30 for rotation therewith. A pair of optical detectors **72*a*, 72*b* are disposed adjacent the encoding wheel 70 to identify the shaft position. The illustrated encoding wheel 70 has a pair of diametrically opposed optical indicators 76. The optical detectors 72*a* and 72*b* are mounted 90° from each other with respect to rotation of the shaft 30 for determination of the pause (FIG. 3D) and dwell (FIGS. 3A and 3A') shaft positions. These shaft positions are systematically related to the shaft positions where one of the indicators 76 is aligned with either the first detector 72*a* or the second detector 72*b*, respectively. The indicators 76 may be openings or holes through the encoder wheel, and the optical detectors 72*a* and 72*b* may comprise a light source on one side of the wheel 70 and a photocell on the other side positioned to detect passage of light through one of the openings 76. On each cycle of operation, one of the openings 76 rotates about 90° in the direction shown (FIG. 3A) to the first detector 72*a*, and then about 90° to the second detector 72*b*. Alternatively, four evenly spaced holes 76 could be used with only a single detector 72**.

Each folding head 34 includes an outer contact end 86. Mechanical rotating means which includes the drive means 31 and the clutch/brake mechanism 33 under the control of the control apparatus 35 rotates the shaft 30 in the direction of carton travel, that is, with the periphery of the shaft 30 nearest the conveyor 14 moving in the same direction as the conveyor 14. The shaft 30 is rotated at a rate which is sufficient for the outer contact end 86 to overtake and fold the trailing panel 22 of the travelling blank 12. The outer end 86 thereby contacts the panel 22 (FIG. 3B) at a predetermined distance from the fold line 26, and folds the panel 22 at the fold line 26 (FIG. 3C). When the head 34 is substantially horizontal (FIG. 3D), that is, when the trailing panel 22 is completely folded against the central panel 29, the shaft 30 stops and pauses. When the carton blank panel 22 is conveyed by the conveyor 14 out from under the head 34 (FIG. 3E), and past the line of travel of the head 34, the shaft 30 is rotated (FIG. 3F) to a dwell position (FIG. 3A') and is stopped there.

The operation of the trailing edge folder just described is controlled by the control apparatus 35, which is shown in detail in FIGS. 4 and 5A–5G. Blank sensing means in the form of a carton detector 36 senses the presence of a blank 12 and produces a trailing edge signal when the trailing edge 28 passes the sensor 36. In response to the trailing edge signal, first operating means to be described in detail below causes the shaft 30 to rotate so that the outer end 86 of the folding head 34 strikes the trailing panel 22 at the predetermined distance after the fold line 26. About one-half inch has been found suitable, as this permits sufficient leverage for folding and allows the head 34 to fold the panel 22 flat against the body 29 without letting the arm 32 strike the blank 12. It would be simple enough to dispose the carton detector 36 relative to the shaft 30 so that the head 34 struck the panel 22 properly when promptly actuated by the trailing edge signal but for two things. One is that it is desirable to fold blanks 12 for cartons of different size, and the other is that it is desirable to be able to operate at different speeds. To meet both desires, it is not possible to operate at fixed relative positions of the carton detector 36 and the shaft 30 while promptly actuating the shaft 30 upon receipt of a trailing edge signal. The control apparatus 35 of the present invention accommodates both desires.

In respect to being able to fold cartons of different size, if the carton detector 36 were disposed upstream of the shaft 30 so that the folding head 34 struck the trailing panel 22 at just the proper one-half inch after the fold line 26 for a 10 inch trailing panel, it would strike 5.5 inches before arrival of the fold line for a 4 inch trailing panel. On the other hand, the folding head 34 would strike too late on a longer trailing panel 22. Therefore, in accordance with the present invention, the carton detector 36 is disposed at a predetermined location upstream of the shaft 30 that will permit the longest trailing panel 22 to be struck properly, and electronic delay is introduced to delay actuation of the shaft until the proper time for shorter panels. This is accommodated by a carton depth advance circuit 112, which may also properly be called a panel length advance circuit, as it is the length of the trailing panel 22 that forms the depth of the resulting carton.

The particular panel length advance circuit 112 illustrated (FIG. 5D) includes a counter for counting clock pulses at a rate proportional to the speed of the conveyor 14. This makes the count a function of distance along the conveyor 14. The counter is set to produce an output signal when the count reaches some predetermined number, which may be when the counter overflows. This predetermined number is large enough to accommodate the longest trailing panel 22 and corresponds to the location of the carton detector 36 relative to the shaft 30. The counter is preset to a number proportional to the length of the panel 22, as may be determined by measurement. Upon receipt of a signal corresponding to a trailing edge signal, the counter counts from the preset number to the predetermined number and produces the output signal. The preset number corresponds to how much advance is necessary from the trailing edge to the desired point of impact, such advance being panel length (as measured) less the desired offset from the fold line (a constant). As it is impossible to advance time electronically, the advance is achieved by the fixed mechanical advance introduced by disposing the carton detector 36 a fixed distance upstream of the desired point of impact, which is at the folder in fixed relation to the shaft 30. Then a delay is introduced electronically to provide the desired net advance appropriate for the particular length of the panel. As the desired net advance is panel length less offset, the delay required is the complement thereof, that is, the remainder of the mechanical offset. This corresponds to the number counted by the carton depth advance counter in counting from the preset number (panel length) to the predetermined number (mechanical advance). As the output signal is at a time providing a net advance, it may be called a panel length advance signal, even though it defines an interval after the trailing edge signal that is complementary to the length of the trailing panel. (These may be considered complementary even though there is a constant offset between the fold line 26 and the point of impact of the folding head 34.)

In respect to being able to operate at different speeds, the clutch/brake mechanism 33 has an inherent response time delay that varies with operating speed. This is occasioned principally by the time required for build up in the magnetic field of a respective solenoid and the inertia of the mechanism. The response time delays in the brake and clutch modes may be the same or different. In general the response time delays are made substantially the same for stopping and starting the shaft 30. The response time delay is substantially the same in units of time at all speeds. This makes the response time delay in units of length less at slower speeds. As a result, if the timing is appropriate for striking the panel 22 at the proper place at high speed, the folding head 34 will strike too soon at slower speeds. This is compensated for by introducing an adjustable response time advance to offset the response time delay. This is achieved by a response time advance circuit 120 which is preferably in much the same form as the carton depth advance circuit 112. That is, a mechanical advance is introduced and an interval corresponding to the respective response time delay is subtracted therefrom to leave an interval substantially complementary to the respective response time delay. The mechanical advance in the case of the striking of the panel 22 is introduced in the same manner as in the case of panel length by appropriately locating the carton detector 36 relative to the shaft 30. This may be done empirically in setting up the system. It is only necessary that the total advance for both panel length and response time delay accommodate both the longest panel and the fastest speed. A response time advance counter is adjusted to provide an output signal after a predetermined count is reached. A preset number is introduced into the counter that is empirically related to conveyor speed and corresponds to the respective response time delay at the operating speed. The counter counts pulses corresponding to operating speed. The counter then provides an output signal at an interval of movement after the input signal that is complementary of the respective response time delay, hence providing a net response time advance that offsets the respective response time delay.

In operation, the two intervals are added together. Thus, upon the occasion of a trailing edge signal indicating that a blank 12 is leaving the location of the carton detector 36, rotation of the shaft 30 is delayed while the carton 12 travels from the sensor 36 toward the edge folder to the position so that when the shaft 30 rotates, the contact end 86 of the head 34 contacts the trailing panel 22 at this predetermined distance from the fold line 26, preferably about ½ inch from the fold line 26. Upon summing the intervals, the total length of the delay depends on both the length of the panel 22, which is the distance between the fold line 26 and the trailing edge 28, and the respective response time delay of the clutch/brake mechanism 33.

A first operating means causes the shaft drive means 31 and clutch/brake mechanism 33 to rotate the shaft after the delay interval. The first operating means includes the circuit 112 (FIG. 4) responsive to the sensor 36, which compensates for carton depth, the circuit 120 responsive to the output of the circuit 112 which compensates for the clutch/brake response time and one mode of an event sequencer 124. The first operating means causes the shaft 30 to rotate to strike the trailing panel 22 appropriately and fold it over at the fold line 26.

First stop means cause the clutch/brake mechanism 33 to stop the shaft 30 upon completion of the fold for a predetermined interval, permitting the conveyor 14 to move the folded carton blank 12 out from under and clear of the head 34. As noted above, the clutch/brake mechanism 33 has inherent respective response time delays. For this reason a compensating response time advance must be introduced in order that the signal to operate the clutch/brake mechanism may be applied sufficiently in advance of when the shaft 30 is to be stopped that the shaft 30 be stopped in the position shown in FIG. 3D with the folding head 34 substantially horizontal. This response time advance is provided by the response time advance circuit 120 in substantially the same manner as described above in connection with the first operating means. In this case, a first stop sensor **72*a* produces a signal when the shaft 30** rotates to a predetermined point in advance of where it is desired to stop, and the signal is applied to the response time advance circuit 120. A second mode of the event sequencer 124 causes the shaft operating means to stop the shaft 30 after the respective response time interval. A pause circuit 126, which is responsive to the output of the event sequencer 124, causes the shaft 30 to pause in that position while the folded carton blank panel slides out from under the head 34 by the conveyor 14. A third mode of the event sequencer 124 then causes the shaft to rotate further in the same direction.

Second stop means responsive to the further rotation of the shaft 30 cause the shaft 30 to stop in the same manner as the first stop means did. When the shaft 30 reaches a second predetermined point, a second stop sensor **72*b* produces a second position signal which is applied to the response time advance circuit 120. After an interval which also corresponds to a respective response time, the fourth and final mode of the event sequencer 124 causes the shaft 30 to stop at a dwell position 180° from the start. The next cycle begins when the blank sensor 36 detects the trailing edge 28 of another blank 12**.

Additional features of the control apparatus include circuitry for servicing and maintenance.

Figure 5A:
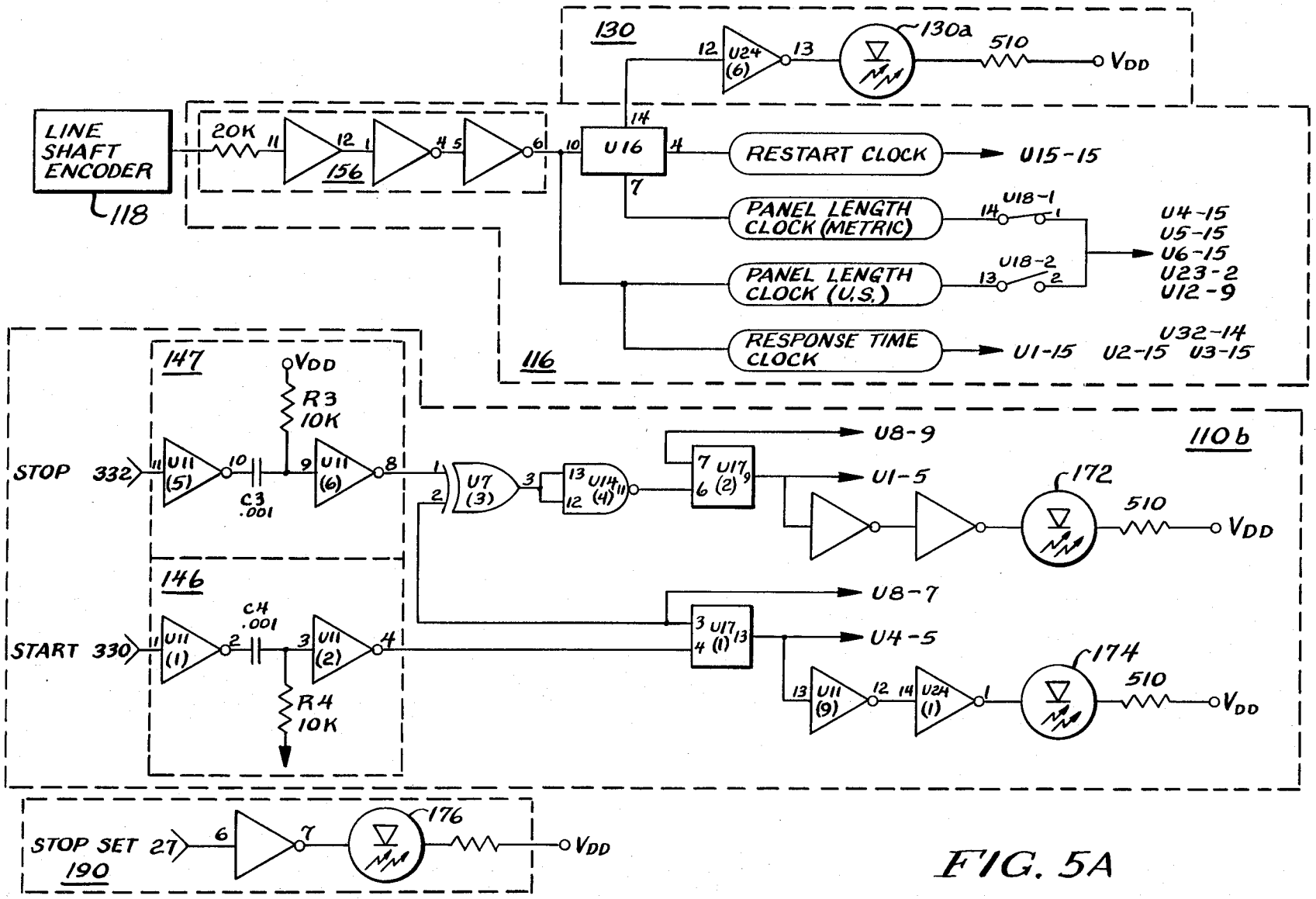
FIGS. 5A–5G are schematic diagrams of portions of the apparatus shown in FIG. 4.
Figure 5B:
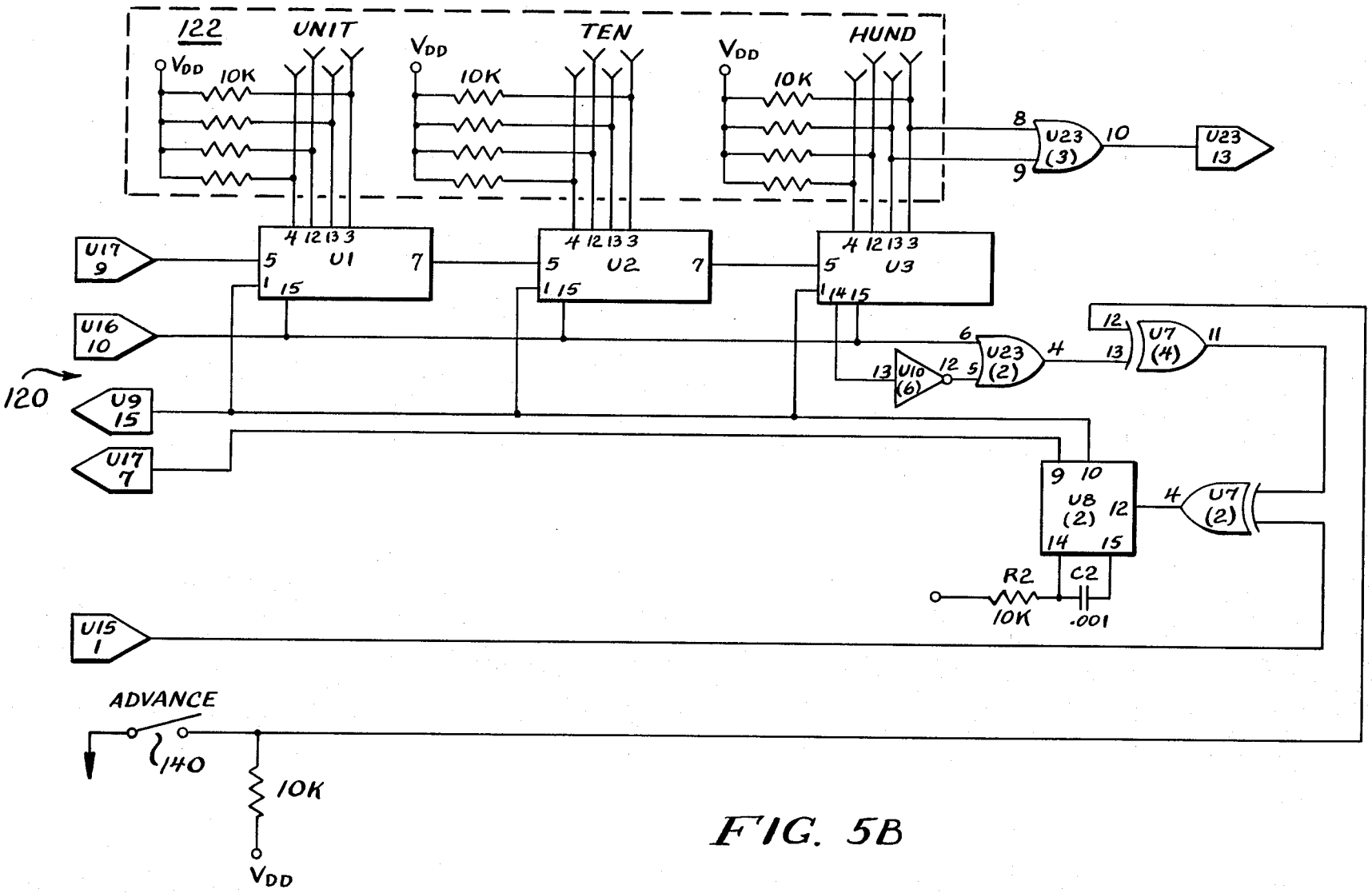
Figure 5C:
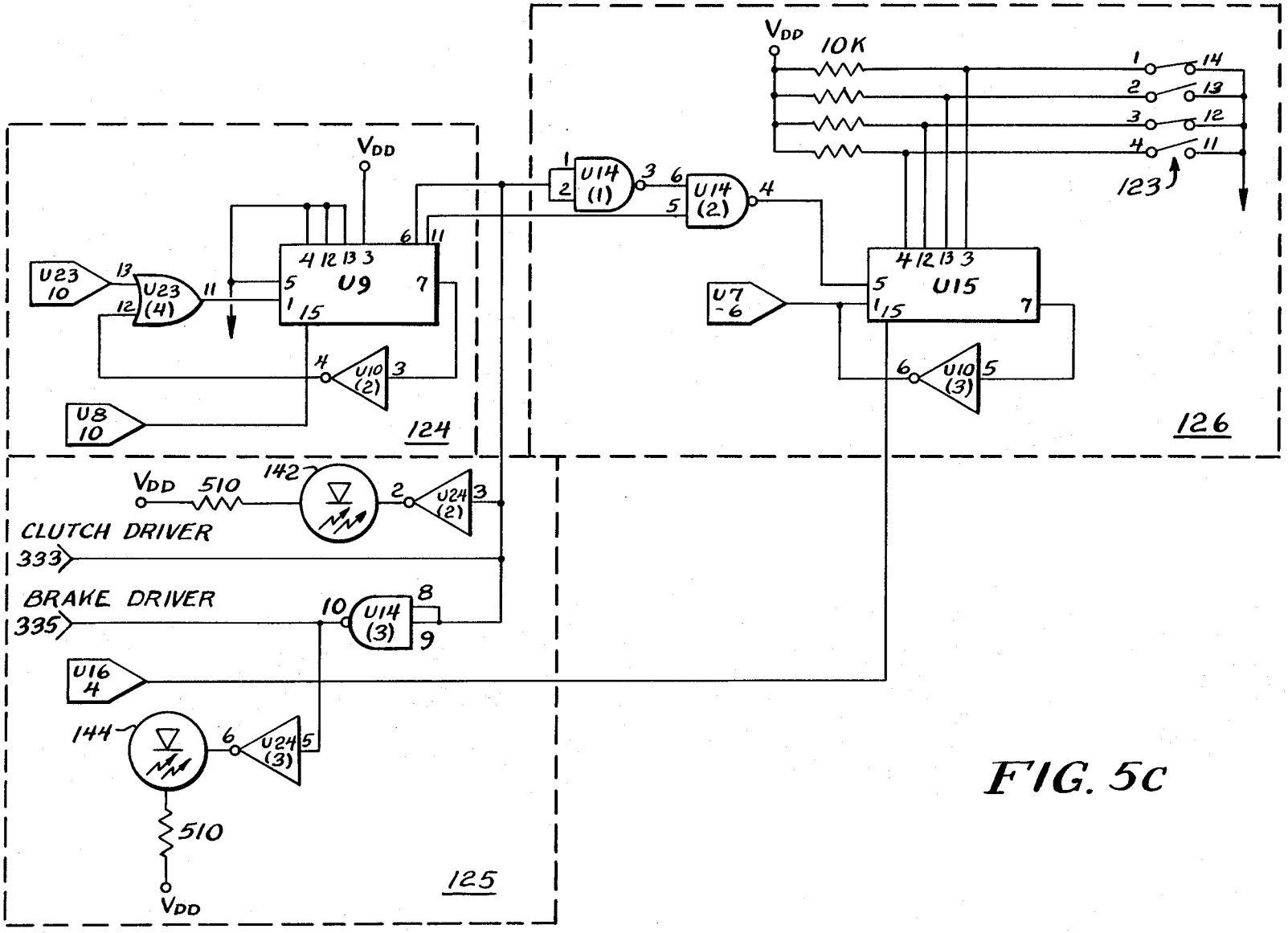
Figure 5D:
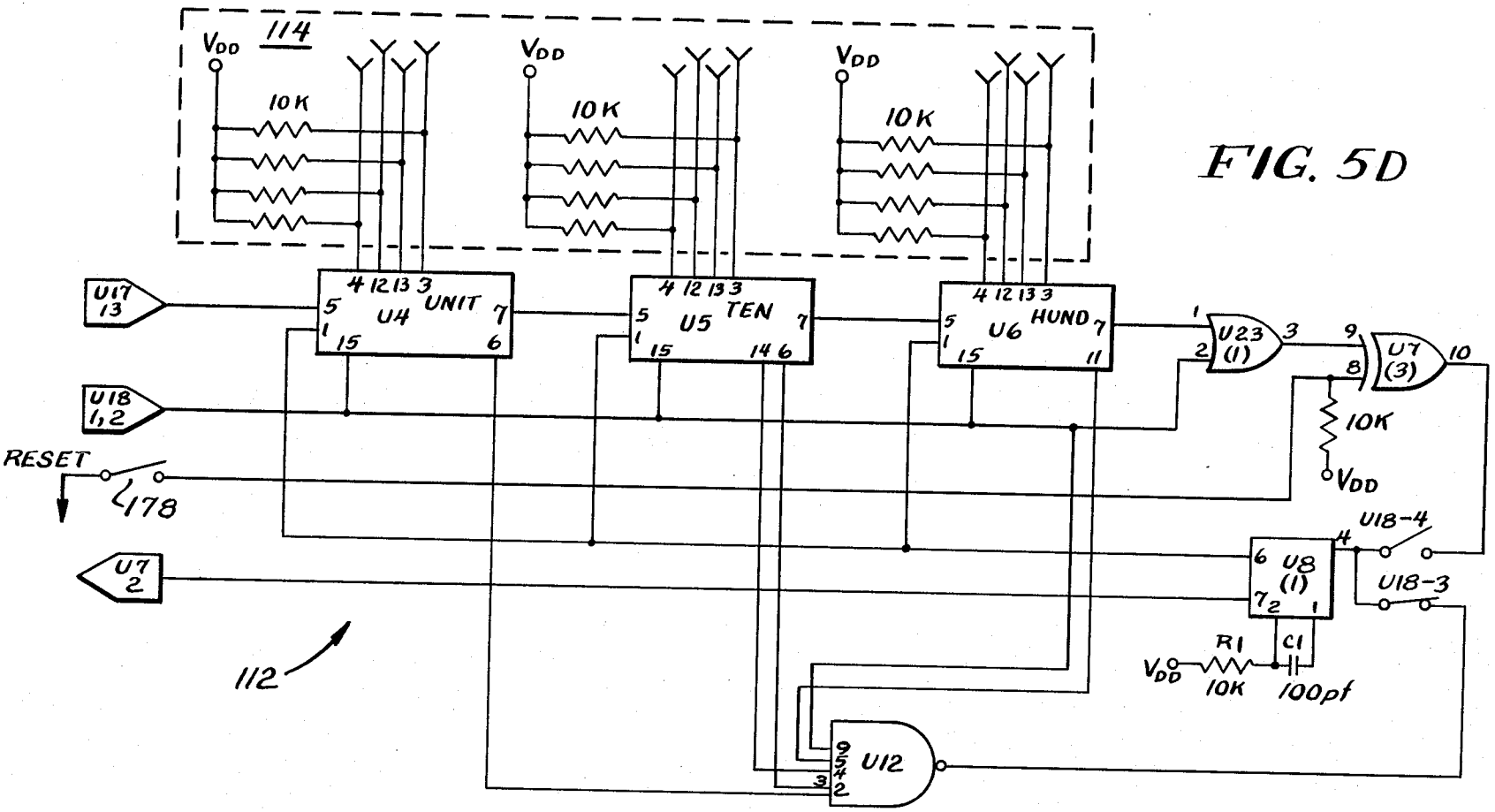
Figure 5F:
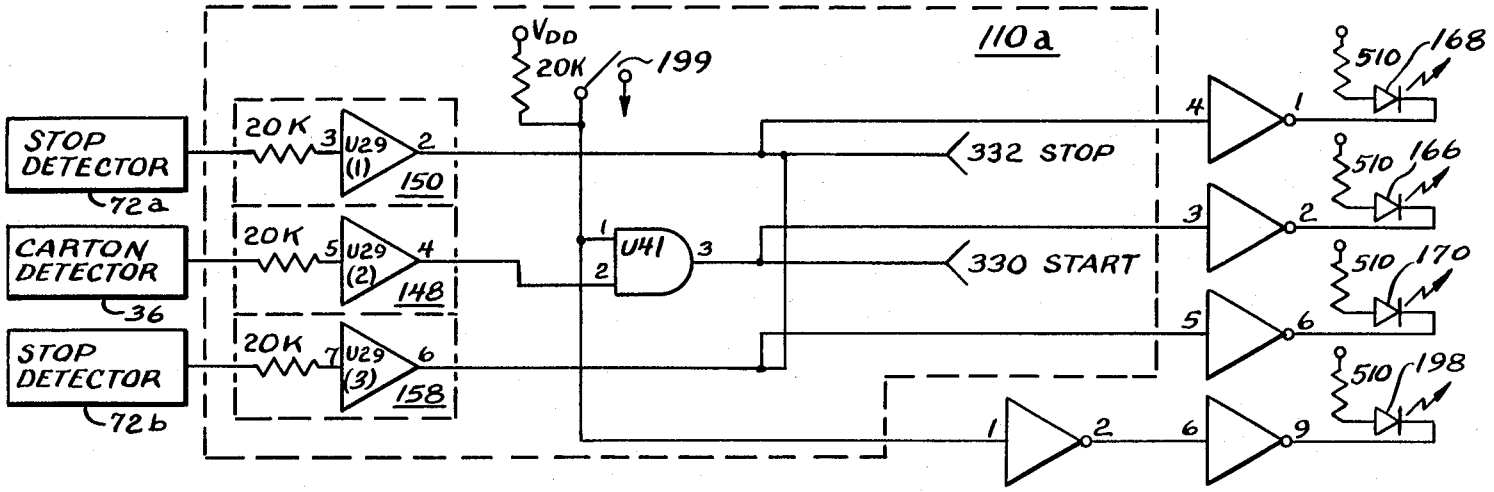

Turning now to a more detailed description of the control apparatus 35 and its manner of operation, the presence of a carton blank 12 at a first location along the path of the conveyor 14 is sensed by the carton detector 36 (FIG. 5F). The carton detector 36 may be a diffuse photoelectric sensor or the like which is responsive to the trailing edge 28, and provides a trailing edge signal to the first operating means to cause the shaft 30 to rotate.

A signal conditioner and input control circuit 110 (**110*a* and 110*b*) may be connected to the output of the carton detector 36. The signal conditioner and input control circuit 110 includes an input signal conditioner 148 having the configuration and components shown in FIG. 5F which sharpens the rise and fall times of the input signals from the carton detector 36. The signal conditioner 148** includes a buffer U29(2), which may be a National Semiconductor CD4010M/CD4010C buffer or the like.

An edge trigger circuit 146 (FIG. 5A), which is responsive to the trailing edge of the output signal of the input signal conditioner 148, has the components and configuration shown. The edge trigger circuit 146 provides a reset pulse at an input terminal U17-4 of a NAND R/S latch U17(1). The latch U17(1) may be a CD4044BM/CD4044BC or the like having a set input pin U17-3 and an output pin U17-13, in addition to the reset input pin U17-4.

The output at pin U17-13 of the latch U17(1) enables a carton depth advance circuit 112 (FIG. 5D). The carton depth advance circuit 112 comprises a carton depth advance (or panel length advance) counter which includes a series of three cascaded counters U4, U5 and U6, such as CD4029BM/CD4029BC presettable counters or the like. Each of the counters U4, U5 and U6 includes a clock input pin 15, a preset enable pin 1, preset input pins 4, 12, 13 and 3, carry out pin 7, and output pins 6, 14 and 11.

The counters U4, U5 and U6 count up to a predetermined number from a preset number which is determined by a panel length adjust switch 114. The counter U4 respresents the least significant digit, the counter U5 is the middle digit, and the counter U6 represents the most significant digit. The switch 114 is a thumb wheel switch or the like having a display which is systematically related to the length of the trailing panel 22, as measured from the fold line 26 to the trailing edge 28.

The circuit 112 essentially counts pulses produced by a line shaft encoder 118, which may be an optical decoder or the like operatively connected to the drive mechanism of the conveyor 14. In this manner, the panel length advance circuit 112 is synchronized with the operating speed of the folding machine, and need not be adjusted if the speed is changed. That is, the counts correspond to units of length rather than units of time.

In apparatus actually made, the shaft encoder 118 produced pulses which each represented about 0.01 inch of travel of the carton blank 12. If the carton depth is measured in inches, the pulses of the line shaft encoder 118 are provided directly to the clock input terminals 15 of the counters U4, U5 and U6, through a signal conditioner 156 and a switch U18-2. If the carton depth is measured in millimeters, the pulses from the encoder 118 are fed to the clock input U16-10 of a binary counter U16, which may be a CD4040BM/CD4040BC ripple counter or the like. The output of terminal U16-7 divides the encoder 118 pulses and provides appropriate clock pulses to the counters U4, U5 and U6 through a switch U18-1.

If the carton depth is measured in millimeters, a switch U18-3 is closed, and a switch U18-4 is opened. When the counters U4, U5 and U6 have a binary output state of 250, a multiple input NAND gate U12 decodes the output. A clock pulse is provided to an input pin U12-9 to produce a pulse output from the gate U12.

The output of the gate U12 is connected through the switch U18-3 to input terminal U8-4 of a monostable flip-flop U8(1), which produces a positive pulse at terminal U8-6, and a negative pulse at terminal U8-7. The length of the pulse is determined by a resistor R1 and a capacitor C1.

If the carton depth is measured in inches, the switch U18-3 is open, and the switch U18-4 is closed. The counters U4, U5 and U6 count from the number determined by the switch 114, until the counter U6 produces an output at carry-out pin U6-7. The output pin U23-3 of an OR gate U23(1) goes low for one clock pulse, and produces an output from pin U7-10 of an EXCLUSIVE OR gate U7(3), which is connected to the input terminal U8-4 of the trigger U8(1). The trigger U8(1) produces the pulses previously described. In this manner, the carton blanks may be measured in either system.

The pulse from terminal U8-6 resets the counters U4, U5 and U6 to their preset number through preset enable pins U4-1, U5-1 and U6-1. The pulse from terminal U8-7 is connected to the set input terminal U17-3 of the flip-flop U17(1) (FIG. 5A), and an input pin U7-2 of an EXCLUSIVE OR gate U7(3). The flip-flop U17(1) disables the counters U4, U5 and U6 until the start of the next cycle, and the output of the gate U7(3) is inverted in a gate U14(4), which produces a pulse at reset input terminal U17-6 of a flip-flop U17(2).

The panel length advance circuit 112 delays the operation of the edge folder during the interval when the trailing edge of the carton blank travels from the sensor 36 to the vicinity of the head 34. The switch 114 adjusts the interval for different sized cartons. Since the interval decreases as the carton size increases, the counter counts a number which is the difference between the preset number corresponding to carton depth and the predetermined number, or the complement of the carton depth.

The output at terminal U17-9 of the flip-flop U17(2) is a carton depth (or panel length) output signal which is applied as an input signal to the response time advance circuit 120 (FIG. 5B). The response time advance circuit 120 provides a delayed response time output signal which compensates for response time delay of the clutch/brake mechanisms 33 which controls the moving and stopping of the shaft 30.

The circuit 120 is a counter which may include cascaded counters U1, U2 and U3, which may be CD4029BM/CD4029BC presettable counters or the like. The counter U1 represents the least significant digit, the counter U2 the next most significant digit, and the counter U3 is the most significant digit. The counters U1, U2 and U3 count up to a predetermined number (400 in the circuit shown) from a number preset by a thumb wheel switch 122. The preset number is preset to correspond to the respective response time delay. The predetermined number 400 corresponds to about 4.00 inches of travel of the carton. The clock inputs U1-15, U2-15 and U3-15 for the counters U1, U2 and U3 are provided directly by the line shaft encoder 118 and hence are of a pulse rate corresponding to conveyor speed.

The circuit 120 provides a maximum delay interval which corresponds generally to about four inches of conveyor travel. The encoder wheel 70 or other device which actuates stop detectors *72a, 72b* is adjusted so that the edge folder operates properly at the maximum speed of the conveyor, with the circuit 120 set for a delay of about 3.50 inches.

The response time delay of both the clutch and the brake in the clutch/brake mechanism 33 may be about 8 milliseconds, which is substantially independent of the conveyor operating speed. When the machine speed changes, the circuit 120 may be adjusted accordingly, to provide the proper delay interval. The delay provided is the difference between the preset number and predetermined number 400, or the complement of the preset number.

When the counter U3 reaches 4, terminal U3-14 goes high. The pulse is inverted in an inverter U10(6) so that pin U23-5 of an OR gate U23(2) goes low, and output pin U23-4 of the gate U23(2) goes low for one clock pulse. The output at pin U23-4 of the gate U23(2) is processed through an EXCLUSIVE OR gate U7(4) and another EXCLUSIVE OR gate U7(2), which provides a positive pulse at input pin U8-12 of a monostable triggerable flip-flop U8(2). The flip-flop U8(2) produces a response time output pulse at pin U8-10 which resets the counters U1, U2 and U3 to their preset states. The flip-flop U8(2) also produces a pulse at pin U8-9 which resets the flip-flop U17(2) (FIG. 5A). The length of the pulses is determined by a resistor R2 and a capacitor C2 connected as shown.

The pin U8-10 response time output pulse (FIG. 5B) is a first advance control signal which is provided to the input of the event sequencer 124 (FIG. 5C) at the end of an interval which is the sum of both the interval which is complementary to the panel length, and the interval which is complementary to the respective response time delay. In the apparatus shown, the panel length advance means is responsive to the trailing edge signal and the response time advance means is responsive to the panel length output signal. It is also contemplated that the trailing edge signal be applied to the response time advance means, and the response time output signal applied to the panel length advance means, with the panel length output signal being applied as the first advance control signal.

The event sequencer 124 includes a binary counter U9, such as a CD4029BM/CD4029BC presettable counter or the like, programmed to count down. Input terminals 3, 4, 12 and 13 are preset to the binary number 4. An output terminal U9-6 controls the clutch/brake mechanism 33 of the shaft 30 through a clutch/brake manager 125. When terminal U9-6 is low, the clutch is off and the brake is on. At the beginning of each cycle, both terminals U9-6 and U9-11 are low, which corresponds to a binary "4" output state. This is the rest or standby state of the event sequencer 124.

When the counter U9 receives the first advance control signal at clock terminal U9-15 from the output pin U8-10 of the response time delay circuit 120, counter U9 counts down to a binary "3" output state, and the outputs of both terminals U9-6 and U9-11 go high. The event sequencer 124 is thereby placed in the first mode and operates as first advance control means to release the brake through a terminal 335 and engage the clutch through a terminal 333, and the shaft 30 begins to rotate after the respective response time delay.

The shaft 30 rotates from the position shown in FIG. 3A, through those in FIGS. 3B and 3C, to the position shown in FIG. 3D. At a predetermined distance prior to the reaching of the position shown in FIG. 3D, the photoelectric sensor *72a* initiates a first position or "stop" signal. An input signal conditioner 150 (FIG. 5F) having a buffer U29(1) is provided to sharpen the rise and fall times of the signal generated by the stop detector *72a.* An edge trigger circuit 147 (FIG. 5A), which includes inverters U11(5), U11(6), a capacitor C3 and a resistor R3, is responsive to the trailing edge of the signal from the stop detector *72a,* and provides a pulse input to the EXCLUSIVE OR gate U7(3). The output of the gate U7(3) is inverted in the gate U14(4) and fed to the flip-flop U17(2).

The output of the flip-flop U17(2) is fed to the input U1-5 (FIG. 5B) of the counter U1 of the response time advance circuit 120. The counters U1, U2 and U3 again count from their preset number to 400, and produce a trigger output at pins U8-9 and U8-10. The U8-9 pulse resets the flip-flop U17(2) (FIG. 5A), and the U8-10 pulse resets the counters U1, U2 and U3 (FIG. 5B). This time the U8-10 response time output pulse changes the counter U9 binary state from "3" to "2". The event sequencer 124 is thereby placed in the second mode and operates as first stop actuating means. Terminal U9-6 (FIG. 5C) goes low, the clutch is disengaged, the brake is engaged on the shaft 30, and the shaft 30 stops after the respective response time delay in the position shown in FIG. 3D.

The control apparatus causes the shaft 30 to pause when it stops in the position shown in FIG. 3D until the carton blank 12 is moved out from under and beyond the path of travel of the folding head 34 and the arm 32. In the binary "2" output state, the event sequencer outputs at terminals U9-6 and U9-11 (FIG. 5C) force the output pin U14-4 of a NAND gate U14(2) low. The output pin U14-4 is part of a restart control circuit 126.

The restart control circuit 126 further includes a counter U15, such as a CD4029BM/CD4029BC counter or the like. A clock pulse for the counter U15 is provided by the pin U16-4 of the clock counter U16 (FIG. 5A), which divides the encoder 118 pulses so that each pin U16-4 pulse represents about 0.8 inch of conveyor travel independent of operating speed. The counter U15 is set to a predetermined binary number by a dip switch 123, which determines the distance which the conveyor travels during the pause, regardless of the operating speed.

When the counter U15 (FIG. 5C) completes its sequence, the carry out pin U15-7 resets the counter U15 to its predetermined value, and generates output pulses from the trigger U8(2), through the gate U7(2) (FIG. 5B). The pin U8-9 pulse sets the flip-flop U17(2) (FIG. 5A), and the pin U8-10 pulse is a second advance control signal which changes the counter U9 output state from a binary "2" to a binary "1". The event sequencer 124 is thereby placed in the third mode and operates as second advance control means. Terminal U9-6 (FIG. 5C) goes high, the clutch engages the shaft 30, and the brake is disengaged. Thus, the second advance control signal is developed a predetermined time after the first stop control signal.

The shaft 30 rotates from the position shown in FIG. 3D to the position shown in FIG. 3A'. As before, at a predetermined distance prior to the reaching of the position shown in FIG. 3A', the stop detector 72*b* produces a second position "stop" signal through a signal conditioner 158 (FIG. 5F). The signal from the detector 72*b* generates an output change at the pin U17-9, which initiates a timing sequence in the response time advance circuit 120, as previously described. The output at the pin U8-10 (FIG. 5B) changes the binary output of the counter U9 (FIG. 5C) to "0". The event sequencer 124 is thereby placed in the fourth mode and operates as second stop actuating means, causing the shaft 30 to stop after the respective response time delay in its dwell position, with the heads 34 below the conveyor 14. This is the position shown in FIG. 3A but with the positions of the arms 32 interchanged. The counter U9 resets itself to a binary output state of "4" through an inverter U10(2) and an OR gate U23(4), in anticipation of the next cycle, placing the event sequencer 124 back in its rest mode.

An OR gate U23(3) (FIG. 5B), which is responsive to the state of the input terminals U3-3 and U3-13 created by the switch 122, provides an output at pin U23-10 to pin U23-13 of the gate U23(4). The output of the gate U23(3) prevents U9 from changing output states if the switch 122 is set to 4 or more.

The clutch/brake manager 125 (FIG. 5C) controls the clutch and brake solenoids 152, 154 (FIG. 5E) through a clutch/brake drive controller 127. Power is provided to the solenoids 152, 154 by a voltage regulator LM350 having a voltage output determined by a resistor R6, and parallel resistors R5 and R7. The solenoids 152, 154 are controlled by transistors D44(A) and D44(B), respectively.

Figure 5E:
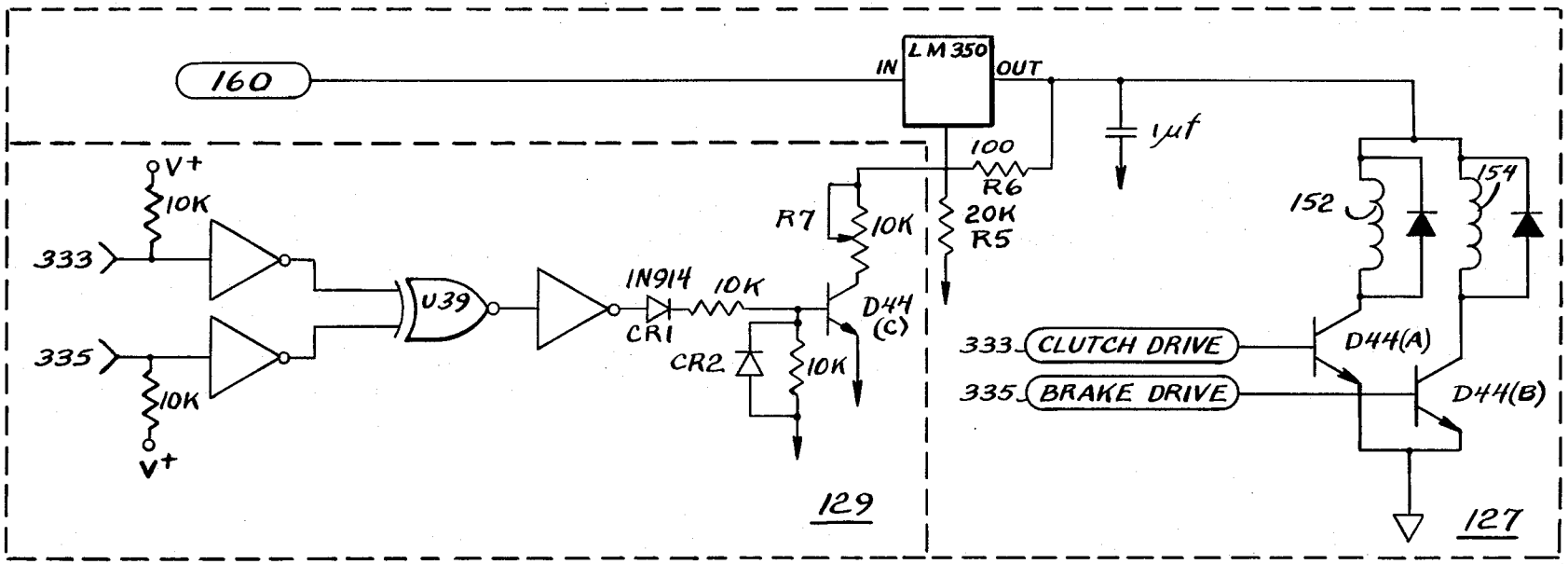
Figure 5G:
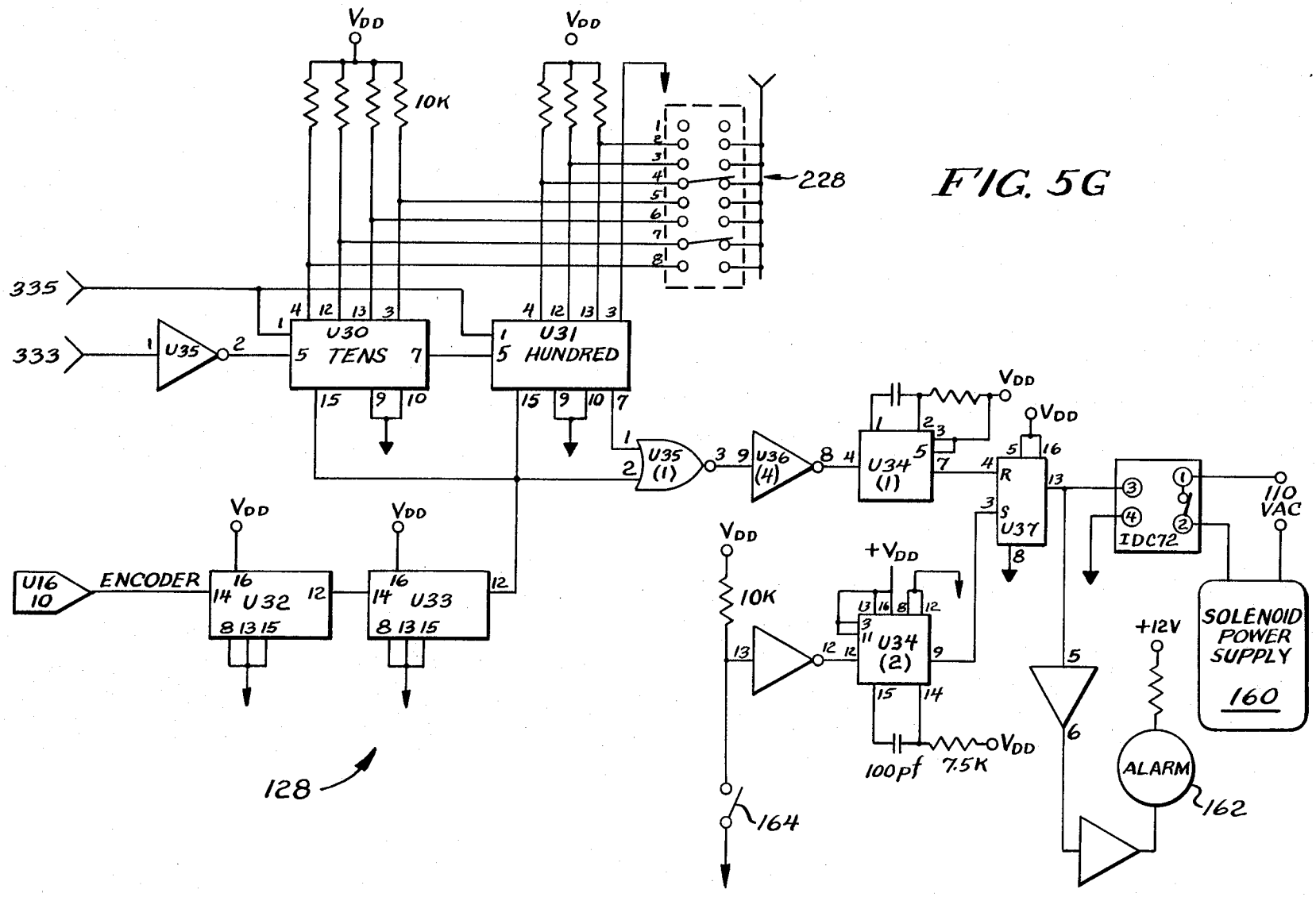

The response time delay of the solenoids 152, 154 is decreased by an overenergizing circuit 129 (FIG. 5E). Every time either the clutch or the brake is engaged, an output pulse is generated by an EXCLUSIVE OR gate U39. The pulse is inverted, and turns off a transistor D44(C) momentarily. The voltage drop across the resistor R5 is increased, and the output of the regulator LM350 approximately doubles for a short time. The voltage surge decreases the response time delay of the solenoids 152, 154.

Additional circuitry is provided for set-up, monitoring, malfunction detection and malfunction analysis. A jam detection circuit 128 (FIG. 5G) disables the solenoid power supply 160 if the brake driver does not go high within a predetermined time after the clutch driver goes high. The circuit 128 includes two cascaded presettable jam counters U30 and U31, which may be CD4029BM/CD4029BD counters or the like, and two cascaded ripple counters U32 and U33, such as CD4017BM/CD4017BC counters or the like. A dip switch 228 determines the time for which the counters U30 and U31 count.

The counters U32 and U33 divide the encoder 118 pulses by 100, and provide a clock pulse from the pin U33-12 to the pins U30-15 and U31-15. Counters U30 and U31 start counting when the pin U9-6 (FIG. 5C) goes high, indicating that the clutch is operative. The pin U9-6 (FIG. 5C) is connected to the carry in pin U30-5 through an inverter U35.

If the pin U9-6 goes low before the counters U30 and U31 finish counting, the brake driver terminal 335 will go high, and the preset enable pins U30-1 and U31-1 will stop the counters U30 and U31 and return them to their preset input state. If a jam occurs, however, and the brake driver terminal 335 does not go high before the counters U30 and U31 finish counting, the carry out pin U31-7 goes high, and a NOR gate U35(1) goes low for one clock pulse. The output of the gate U35(1) is inverted in an inverter U36(4), providing an input to a monostable trigger circuit U34(1) which produces a pulse at pin U34(1)-7 to reset input pin U37-4 of a flip-flop U37. The output pin U37-13 energizes a relay IDC72, which disables the solenoid power supply 160, and enables an alarm 162, which alerts the operator that a jam has occurred.

When the jam is cleared, the operator may momentarily close a switch 164, which produces a pulse in a trigger U34(2), and changes the output state of the flip-flop U37. Power is restored to the solenoids, and operation may resume.

The machine speed may be monitored by a speed indication circuit 130 (FIG. 5A), which includes an LED 130*a* that flashes at a rate which is proportional to the pulse rate generated by the encoder 118. The LED 130*a* may be used to identify and diagnose malfunctions in the encoder 118 and the counter U16.

An LED 166 monitors the output of the sensor 36, and LED's 168 and 170 monitor the output of the stop detectors 72*a*, 72*b*, respectively. An LED 172 is illuminated to indicate that the counters U1, U2 and U3 are enabled, and an LED 174 indicates that the counters U4, U5 and U6 are enabled. An LED 142 indicates that the clutch is engaged, and an LED 144 indicates that the brake is on.

Additional encoder wheel slots and an associated optical decoder (not shown) may be provided, if desired, to produce an input to a stop set detector circuit 190 (FIG. 5A). An LED 176 will illuminate when the encoder wheel 70 stops in the correct mechanical position.

Figure 4:
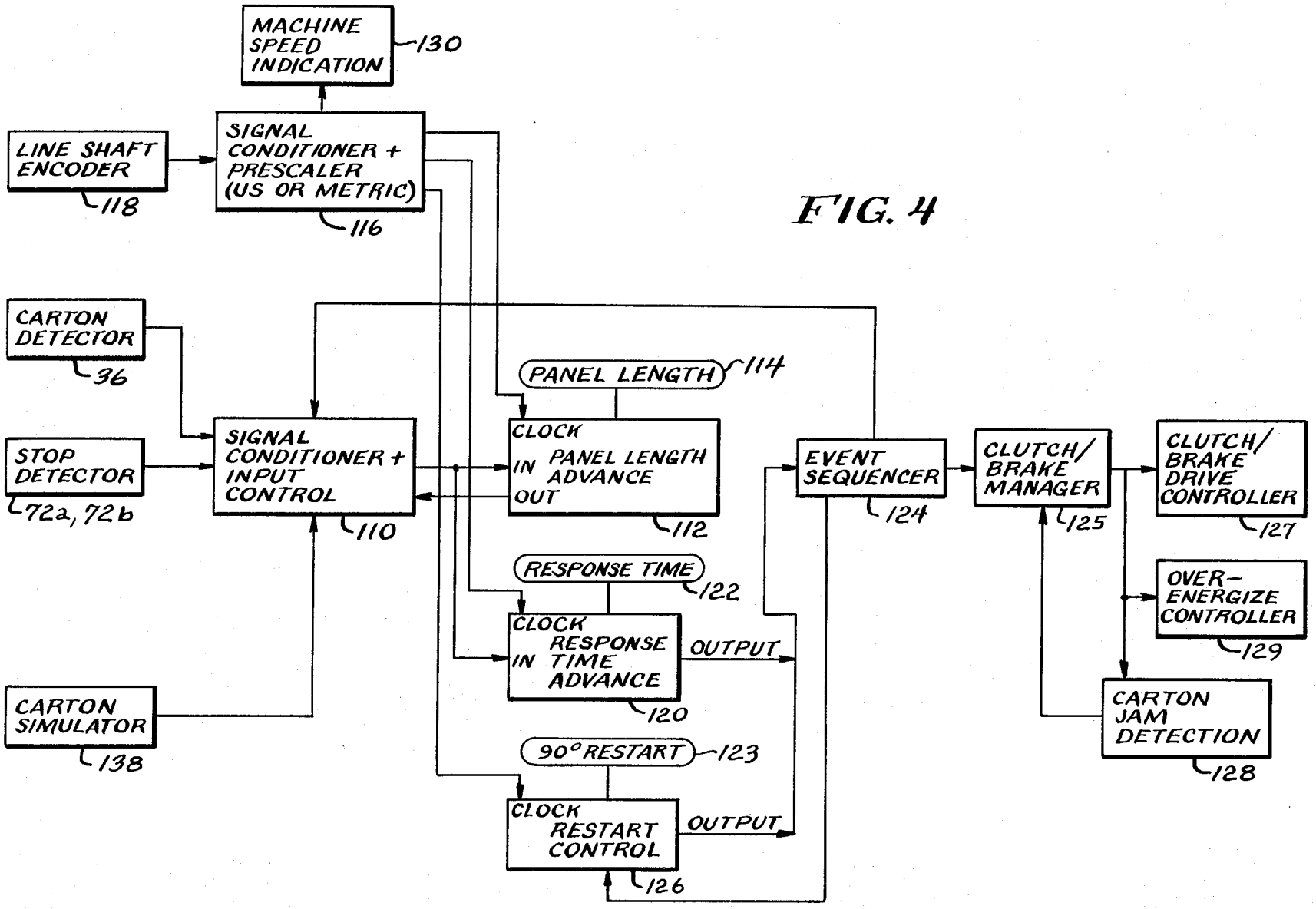
FIG. 4 is a block diagram of the control apparatus of the present invention for controlling the folder shown in FIG. 1.

For test and set-up purposes, a carton simulation oscillator 138, shown in block form in FIG. 4, may be used to provide pulses at a rate which may be varied from between about 1 pulse/second and about 4 pulses/second, to simulate a series of carton blanks 12 passing the carton detector 36.

A manually operated advance switch 140 (FIG. 5B) is provided at pin U7-12 so that the counter U9 may be manually changed from one state to another when the machine is not operating. The switch 140 is useful for servicing the control apparatus. The LED's just described are diagnostic aids when manually exercising the control circuits.

A reset switch 178 (FIG. 5D) is provided for presetting the counters U4, U5 and U6 to the preset input when operating in the nonmetric mode. A similar switch could be provided for the metric mode, if desired. The switch 178 is generally used when the switch 114 is changed to accommodate a different sized carton blank. By operating the switch 178, the counters U4, U5 and U6 may be preset to a new number without cycling the control apparatus.

An on-off switch 199 (FIG. 5F) is provided which causes an AND gate U41 to block the output of the sensor 36 when the switch 199 is off. An LED 198 illuminates when the switch 199 is on.

In operation, the switches U18-1 and U18-3 are closed, and the switches U18-2 and U18-4 are open when measuring carton depth in the metric system. The state of the switches U18-1, U18-2, U18-3 and U18-4 are reversed when the measurement is made in inches. In either case, the sensor 36 is mechanically positioned so that the switch 114 may be adjusted to correspond to the panel length, and the head 34 contacts the trailing panel 22 in an appropriate place near the fold line 26 when the switch 114 is so adjusted. In this manner, the timing advance of the sensor 36 is partly offset by the delay interval of the panel length advance circuit to provide an advance appropriate for the particular panel length. Since each clock pulse corresponds to 0.01 inch or about 1 millimeter of conveyor travel, the switch 114 may be adjusted and set in inches or millimeters, respectively. As the carton size decreases, the delay increases because the circuit 112 counts the complement of the preset panel length number.

The initial adjustment of the response time advance circuit 120 (FIG. 5B) has been described. The encoder wheel 70 is mechanically advanced so that the trailing panel 22 is properly folded at a maximum operating speed of perhaps 600 conveyor belt feet per minute, with the response time advance circuit adjusted to about 3.50, providing a relatively short delay interval. As the operating speed is reduced under actual operating conditions, the interval is appropriately increased. The exact adjustment of the timing switch 122 (FIG. 5B) is generally made empirically. The switch 123 of the restart control circuit 126 (FIG. 5C) is generally set once, so that the shaft 30 pauses for a suitable movement of the blanks 12 regardless of operating speed. A specific response time delay is not required for the pause function, just enough that the blanks clear the head 34 before it starts moving and not so much that the head 34 is in the way when the next blank 12 comes along.

When the trailing edge 28 of a carton blank 12 passes the detector 36, the detector 36 produces a trailing edge signal which enables the panel length advance circuit 112. The circuit 112 produces an output signal after a first predetermined interval, which output signal enables the response time advance circuit 120. The circuit 120 produces an output after a second predetermined delay. The event sequencer 124 in its first mode causes the shaft 30 to rotate in response to the output of the circuit 120 so that the head 34 moves in the direction of the conveyor 14 and folds the trailing panel 22. The stop sensor **72*a* produces a signal just before the panel 22 is completely folded, enabling the response time advance circuit 120. The circuit 120 produces a first response time output signal which places the event sequencer 124 in the second mode after the predetermined delay, causing the shaft 30 to stop after the response time delay of the clutch/brake mechanism 33 so that the panel 22 is properly folded. The first response time output signal also enables the restart control circuit 126, causing the shaft 30 to pause while the blank 12 moves away from the head 34. After the restart control interval, the output of the circuit 126 places the event sequencer in the third mode, causing the shaft 30 to rotate further. At a second predetermined position, the sensor 72*b* produces a signal which again enables the response time advance circuit 120. The circuit 120 produces a second response time output signal, which places the event sequencer 124 in the fourth mode after the proper interval, causing the shaft 30 to stop rotating after the respective response time delay in a dwell position where the head 34 is clear of the conveyor 14**.

While only one response time advance circuit 120 is used to produce three identical delay intervals per cycle, it is contemplated that more than one separate circuit could be used, if desired, producing respective delay intervals.

The advantages of the control apparatus of the present invention are now apparent. The operation of the trailing edge folder may be accurately and reliably controlled at a high rate. There are very few mechanical parts in the control apparatus which may require periodic maintenance, and circuitry is provided for quickly detecting and diagnosing malfunctions when maintenance is needed. In addition, the control apparatus is adaptable for use at different operating speeds, and with different sized carton blanks.

While the principles of the invention have been described in connection with specific apparatus and applications, it is to be understood that this description is made only by way of example and not as a limitation on the scope of the claims of this invention.

What is claimed is:

1. Apparatus for controlling the operation of a trailing edge folder in a blank folding machine having conveyor means for continuously advancing blanks with trailing panels in a predetermined direction in untimed relationship to one another along a generally horizontal path, said folder having a rotatable shaft mounted below said path and transverse thereto, shaft operating means for rotating and stopping said shaft intermittently after at least one respective response time delay, and arm means mounted on said shaft and extending generally radially therefrom, said arm means having folding head means at the distal end thereof for folding over the respective trailing panel of each of said blanks, said control apparatus comprising:

blank sensing means responsive to the presence of a blank at a predetermined location along said path upstream of said folder for producing a trailing edge signal when the trailing edge of the blank leaves said location;

panel length advance means, responsive to an input signal, for producing a panel length output signal at the end of an interval after said input signal which interval is substantially complementary to the length of said trailing panel, said panel length advance means including a panel length advance counter having a clock input terminal, means for applying clock pulses to said clock input terminal of said panel length advance counter at a rate related to the operating speed of said folding machine, and means for producing said panel length output signal upon the counting of a predetermined number of clock pulses;

response time advance means, responsive to an input signal, for producing a response time output signal at the end of an interval after said input signal which interval is substantially complementary to one of said respective response time delays of said shaft operating means, said response time advance means including a response time advance counter having a clock input terminal, means for applying clock pulses to said clock input terminal of said response time advance counter at a rate related to the operating speed of said folding machine, and means for producing said response time output signal upon the counting of a predetermined number of clock pulses;

means for applying said trailing edge signal as an input signal to one of said panel length advance means and said response time advance means;

means for applying the output signal of one of said panel length advance means and said response time advance means as an input signal to the other of said panel length advance means and said response time advance means to develop a first advance control signal at the end of an interval after said trailing edge signal which is substantially the sum of said interval substantially complementary to said length and said interval substantially complementary to one of said respective response time delays;

first advance control means responsive to said first advance control signal for causing said shaft operating means with at least one respective response time delay to rotate said shaft so that said folding head means moves generally in said predetermined direction to fold over said trailing panel;

first position sensing means, responsive to the rotation of said shaft to a first predetermined position, for producing a first position signal indicative thereof;

means for applying said first position signal as an input signal to said response time advance means to develop a respective response time output signal as a first stop control signal;

first stop actuating means responsive to said first stop control signal for causing said shaft operating means with at least one respective response time delay to stop said shaft;

pause means, responsive to said first stop control signal and the operation of said conveyor means, for developing a second advance control signal at the end of a predetermined pause interval after said first stop control signal;

second advance control means, responsive to said second advance control signal, for further causing said shaft operating means to rotate said shaft after said predetermined pause interval;

second position sensing means, responsive to the further rotation of said shaft to a second predetermined position, for producing a second position signal indicative thereof;

means for applying said second position signal as an input signal to said response time advance means to develop a respective response time output signal as a second stop control signal; and second stop actuating means, responsive to said second stop control signal, for causing said shaft operating means with at least one respective response time delay to stop said shaft in a dwell position where said folding head means is clear of said path.

2. Apparatus according to claim 1 wherein said respective response time delays are substantially the same.

3. Apparatus according to claim 1 wherein said first advance control means, said first stop actuating means, said second advance control means and second stop actuating means each comprises a respective mode of a multimode event sequencer having means for advancing from mode to mode in predetermined sequence.

4. Apparatus according to claim 1 wherein said means for applying said trailing edge signal applies said trailing edge signal to said panel length advance signal.

5. Apparatus according to claim 1, 2, 3, or 4 wherein said pause means comprises a pause counter having a clock input and producing a pause output signal upon the counting of a predetermined number of clock pulses; and means for applying clock pulses to said clock input terminal of said pause counter at a rate which is related to the operating speed of said folding machine.

6. Apparatus according to claim 4 wherein said predetermined number of pulses complementary to said depth is adjustable.

7. Apparatus according to claim 1, 2, 3, or 4 further including jam detection means for indicating that said shaft is not moving freely, said jam detection means comprising a jam counter having a clock input terminal, means for applying clock pulses to said clock input terminal of said jam counter at a rate which is related to the operating speed of said folding machine, means for producing a jam output signal upon the counting of a predetermined number of clock pulses, and means responsive to one of said first and second position signals for stopping said jam counter prior to said predetermined number when said shaft is moving sufficiently freely that a respective one of said first and second positions is reached prior to the counting of said predetermined number of clock pulses.

8. Apparatus according to claim 6 wherein said predetermined number of pulses complementary to said respective response time delay is adjustable.

9. Apparatus according to claim 1, 2, 3, or 4 further including an overenergizer circuit for decreasing a respective said response time delay by momentarily increasing the power applied in response to one of said first and second advance control means and said first and second stop actuating means in causing said shaft to rotate and stop, respectively.

10. Apparatus for controlling the operation of a trailing edge folder in a blank folding machine having conveyor means for continuously advancing blanks with trailing panels in a predetermined direction in untimed relationship to one another along a generally horizontal path, said folder having a rotatable shaft mounted below said path and transverse thereto, shaft operating means for rotating and stopping said shaft intermittently after at least one respective response time delay, and arm means mounted on said shaft and extending generally radially therefrom, said arm means having folding head means at the distal end thereof for folding over the respective trailing panel of each of said blanks, said control apparatus comprising:

blank sensing means, responsive to the presence of a blank at a predetermined location along said path upstream of said folder, for producing a trailing edge signal when the trailing edge of the blank leaves said location;

panel length advance means, responsive to an input signal to said panel length advance means, for producing a panel length output signal at the end of an interval after said input signal which interval is substantially complementary to the length of said trailing panel;

response time advance means, responsive to an input signal to said response time advance means, for producing a response time output signal at the end of an interval after said input signal which interval is substantially complementary to one of said respective response time delays of said shaft operating means;

means for applying said trailing edge signal as an input signal to one of said panel length advance means and said response time advance means;

means for applying the output signal of one of said panel length advance means and said response time advance means as an input signal to the other of said panel length advance means and said response time advance means to develop a first advance control signal at the end of an interval after said trailing edge signal which is substantially the sum of said interval substantially complementary to said panel length and said interval substantially complementary to one of said respective response time delays;

first advance control means, responsive to said first advance control signal, for causing said shaft operating means with at least one respective response time delay to rotate said shaft so that said folding head means moves generally in said predetermined direction to fold over said trailing panel;

first position sensing means, responsive to the rotation of said shaft to a first predetermined position, for producing a first position signal indicative thereof;

means for applying said first position signal as an input signal to said response time advance means to develop a respective response time output signal as a first stop control signal;

first stop actuating means, responsive to said first stop control signal, for causing said shaft operating means with at least one respective response time delay to stop said shaft;

pause means, responsive to said first stop control signal and the operation of said conveyor means, for developing a second advance control signal at the end of a predetermined pause interval after said first stop control signal;

second advance control means, responsive to said second advance control signal, for further causing said shaft operating means to rotate said shaft after said predetermined pause interval;

second position sensing means, responsive to the further rotation of said shaft to a second predetermined position, for producing a second position signal indicative thereof;

means for applying said second position signal as an input signal to said response time advance means to develop a respective response time output signal as a second stop control signal;

second stop actuating means, responsive to said second stop control signal, for causing said shaft operating means with at least one respective response time delay to stop said shaft in a dwell position where said folding head means is clear of said path; and jam detection means for indicating that said shaft is not moving freely, said jam detection means comprising a jam counter having a clock input terminal, means for applying clock pulses to said clock input terminal of said jam counter at a rate which is indicative of the operating speed of said folding machine, means for producing a jam output signal upon the counting of a predetermined number of clock pulses, and means responsive to one of said first and second position signals for stopping said jam counter prior to said predetermined number when said shaft is moving sufficiently freely that a respective one of said first and second positions is reached prior to the counting of said predetermined number of clock pulses.

11. Apparatus according to claim 10 wherein said respective response time delays are substantially the same.

12. Apparatus according to claim 10 wherein said means for applying said trailing edge signal applies said trailing edge signal to said panel length advance signal.

13. Apparatus according to claim 10 wherein said first advance control means, said first stop actuating means, said second advance control means, and second stop actuating means each comprises a respective mode of a multimode event sequencer having means for advancing from mode to mode in predetermined sequence.

14. Apparatus for controlling the operation of a trailing edge folder in a blank folding machine having conveyor means for continuously advancing blanks with trailing panels in a predetermined direction in untimed relationship to one another along a generally horizontal path, said folder having a rotatable shaft mounted below said path and transverse thereto, shaft operating means for rotating and stopping said shaft intermittently after at least one respective response time delay, and arm means mounted on said shaft and extending generally radially therefrom, said arm means having folding head means at the distal end thereof for folding over the respective trailing panel of each of said blanks, said control apparatus comprising:

blank sensing means, responsive to the presence of a blank at a predetermined location along said path upstream of said folder, for producing a trailing edge signal when the trailing edge of the blank leaves said location;

panel length advance means, responsive to an input signal to said panel length advance means, for producing a panel length output signal at the end of an interval after said input signal which interval is substantially complementary to the length of said trailing panel;

response time advance means, responsive to an input signal to said response time advance means, for producing a response time output signal at the end of an interval after said input signal which interval is substantially complementary to one of said respective response time delays of said shaft operating means;

means for applying said trailing edge signal as an input signal to one of said panel length advance means and said response time advance means;

means for applying the output signal of one of said panel length advance means and said response time advance means as an input signal to the other of said panel length advance means and said response time advance means to develop a first advance control signal at the end of an interval after said trailing edge signal which is substantially the sum of said interval substantially complementary to said panel length and said interval substantially complementary to one of said respective response time delays;

first advance control means, responsive to said first advance control signal, for causing said shaft operating means with at least one respective response time delay to rotate said shaft so that said folding head means moves generally in said predetermined direction to fold over said trailing panel;

first position sensing means, responsive to the rotation of said shaft to a first predetermined position, for producing a first position signal indicative thereof;

means for applying said first position signal as an input signal to said response time advance means to develop a respective response time output signal as a first stop control signal;

first stop actuating means, responsive to said first stop control signal, for causing said shaft operating means with at least one respective response time delay to stop said shaft;

pause means, responsive to said first stop control signal and the operation of said conveyor means, for developing a second advance control signal at the end of a predetermined pause interval after said first stop control signal;

second advance control means, responsive to said second advance control signal, for further causing said shaft operating means to rotate said shaft after said predetermined pause interval;

second position sensing means, responsive to the further rotation of said shaft to a second predetermined position, for producing a second position signal indicative thereof;

means for applying said second position signal as an input signal to said response time advance means to develop a respective response time output signal as a second stop control signal;

second stop actuating means, responsive to said second stop control signal, for causing said shaft operating means with at least one respective response time delay to stop said shaft in a dwell position where said folding head means is clear of said path; and an overenergizer circuit for decreasing said respective response time delays by momentarily increasing the power applied to one of said first and second advance control means and to said first and second stop actuating means causing said shaft to rotate and stop, respectively.

15. Apparatus according to claim 14 wherein said respective response time delays are substantially the same.

16. Apparatus according to claim 14 wherein said first advance control means, said first stop actuating means, said second advance control means, and second stop actuating means each comprises a respective mode of a multimode event sequencer having means for advancing from mode to mode in predetermined sequence.

17. Apparatus according to claim 14 wherein said means for applying said trailing edge signal applies said trailing edge signal to said panel length advance signal.

* * * * *